US007156188B2

(12) United States Patent
Bermingham et al.

(10) Patent No.: US 7,156,188 B2
(45) Date of Patent: Jan. 2, 2007

(54) PILE DRIVER WITH ENERGY MONITORING AND CONTROL CIRCUIT

(75) Inventors: Patrick Bermingham, Hamilton (CA); Mark Triska, Ancaster (CA); Michael Justason, Hamilton (CA); Grant Bearss, Hamilton (CA); David Hoover, Hamilton (CA); Stefano Gabaldo, Hamilton (CA); Tim Rosenberger, Hamilton (CA)

(73) Assignee: Bermingham Construction Limited, Hamilton (CA)

( * ) Notice: Subject to any disclaimer, the term of this patent is extended or adjusted under 35 U.S.C. 154(b) by 0 days.

(21) Appl. No.: 10/843,664

(22) Filed: May 12, 2004

(65) Prior Publication Data

US 2005/0023014 A1 Feb. 3, 2005

Related U.S. Application Data

(60) Provisional application No. 60/469,415, filed on May 12, 2003.

(51) Int. Cl.
*E02D 13/00* (2006.01)
*E21B 1/04* (2006.01)

(52) U.S. Cl. ..... 173/2; 173/128; 405/232; 73/11.03

(58) Field of Classification Search ..... 173/10, 173/2, 4, 11, 176, 13, 20, 128; 73/11.03, 73/84, 12.01; 356/141.1; 340/853.8; 405/229, 405/232
See application file for complete search history.

(56) References Cited

U.S. PATENT DOCUMENTS 2,804,856 A 9/1957 Spurlin
3,747,693 A 7/1973 Kummel et al.
4,096,916 A 6/1978 Hennecke et al.
4,365,306 A 12/1982 House et al.
4,508,181 A 4/1985 Jenne
4,586,366 A * 5/1986 Milberger ..... 73/11.03
4,660,655 A 4/1987 Wilner
4,860,835 A 8/1989 Mauch
5,090,485 A 2/1992 Pomonik et al.
5,303,162 A * 4/1994 Yoon ..... 702/33
5,548,397 A * 8/1996 Kool et al. ..... 356/141.1
5,581,013 A * 12/1996 Frederick ..... 73/11.03
5,610,818 A * 3/1997 Ackroyd et al. ..... 455/456.3
5,727,639 A 3/1998 Jeter
5,978,749 A 11/1999 Likins, Jr. et al.

(Continued)

OTHER PUBLICATIONS

Bengt H. Fellenius, Dr. Tech., P. Eng., "Piling Terminology", Basics of Foundation Design, Second Expanded Edition, 1999, http://www.geoforum.com/info/pileinfo/terminology.asp, 8 pages.

(Continued)

*Primary Examiner*—Scott A. Smith
(74) *Attorney, Agent, or Firm*—Nixon & Vanderhye P.C.

(57) ABSTRACT

A pile driver comprises a hammer for impacting a pile, a velocity sensor for measuring the velocity at impact, and a control system for adjusting the hammer stroke in accordance with the readings from the velocity sensor so that the optimal impact energy is imparted to the head of the pile. Optionally, the system further comprises a pile driving analyzer (including at least one strain gauge and/or an accelerometer) mounted on the side of the pile itself to determine whether the impact loading on the pile is below the maximum allowable stress. If the pile driving analyzer senses an overload of stress on the pile, the control system will reduce the velocity of the subsequent hammer stroke so that it no longer exceeds the maximum allowable stress.

15 Claims, 2 Drawing Sheets

U.S. PATENT DOCUMENTS 6,301,551 B1 10/2001 Piscalko et al.
6,533,502 B1 * 3/2003 McVay et al. ..... 405/232

OTHER PUBLICATIONS

Wondem Teferra et al., "Driving Stress Control During the Installation of Precast Prestressed Cylindrical Concrete Piles", Reference Papers, http://web.pile.com/Education/sw1/default.asp?company=, 7 pages, 1996.
"Pile Classification System", Pile Info, http://www.geoforum.com/info/pileinfo/classification.asp, 1 page, copyright 1998-2005.
Frank Rausche et al., "Dynamic Determination of Pile Capacity", Reference Papers, http://web.pile.com/Education/540/default.asp?company=, 17 pages. 1985.
Frank Rausche et al., "Soil Resistance Predictions From Pile Dynamics", Reference Papers, http://web.pile/com/Education/502/default.asp?company=, 15 pages, Sep. 1972.
Garland Likins et al., "Introduction to the Dynamics of Pile Testing", Reference Papers, http://web.pile.com/Education/621/default.asp?company=, 4 pages, Dec. 1990.
"Short history of piling", Pile Info, http://www.geoforum.com/info/pileinfo/view_process.asp?ID=56, 2 pages, copyright 1998-2005.

* cited by examiner

PILE DRIVER WITH ENERGY MONITORING AND CONTROL CIRCUIT

CROSS-REFERENCE TO RELATED APPLICATIONS

This application claims priority from U.S. Provisional Application No. 60/469,415, filed on 12$^{th}$ May, 2003, incorporated herein by reference in its entirety.

FIELD OF THE INVENTION

This invention relates to pile drivers and, more particularly, to pile drivers with control systems.

BACKGROUND OF THE INVENTION

Pile drivers are used in the construction industry to drive piles, also known as posts, into the ground. Piles are used to support massive structures such as bridges, towers, dams and skyscrapers. Piles, or posts, may be made of timber, steel, concrete or composites. To drive a pile into the ground requires high impact energy to overcome the soil resistance. However, the impact energy must not be so large as to damage the post during installation.

Impact stresses are directly related to the impact energy delivered to the pile. During impact, the energy transferred to the pile is a function of force, F(t), and velocity, v(t), both of which vary in time. The impact energy as a function of time, E(t), is calculated as follows:

$$E(t)=\int F(t)v(t)dt$$

The impact energy may be approximated to be the kinetic energy of the hammer just before it impacts the pile head, i.e. $E=\frac{1}{2}mv^2$. However, not all of this kinetic energy is transferred to the pile because of the inelasticity of the collision, which results in deformation and energy dissipation in the form of heat and sound.

There are a variety of pile-driving machines currently known in the industry. There are simple drop-hammer pile drivers that use a cable, winch and crane to raise a mass above the pile and simply let the hammer free-fall onto the top of the pile (also known as the pile head), as illustrated in U.S. Pat. No. 4,660,655 (Wilner). Sometimes the drop hammer has a vertical guide or rail to ensure greater accuracy during the drop. These guided drop hammers are shown in U.S. Pat. No. 5,978,749 (Likins, Jr. et al.) and in U.S. Pat. No. 6,301,551 (Piscalko et al.). Pile drivers may also be hydraulically actuated as in U.S. Pat. No. 5,090,485 (Pomonik et al.) or pneumatically driven as in U.S. Pat. No. 4,508,181 (Jenne). There are also diesel-powered pile drivers (which are also known as free piston internal combustion pile drivers). The diesel pile driver uses the piston as the impacting hammer. This type of pile driver is described in U.S. Pat. No. 5,727,639 (Jeter).

One of the main recurrent problems in pile driving is controlling the impact of the hammer on the pile. If the impact energy is too little, the pile does not penetrate the soil and time and energy is lost. If the impact energy is too great, the pile may be damaged or broken. Indeed, concrete piles are susceptible to cracking if the impact stresses are too large.

Traditionally, foundation engineers have relied on static or dynamic analyses, probe piles and static testing to ensure a safe and efficient installation. However, the dynamic formulae are intrinsically inaccurate because the dynamic modeling of the hammer, driving system, pile and soil is based on simplifications and assumptions that do not always simulate reality. Even if dynamic models were further refined, they would still not be able to account for the fact that soil conditions may vary with depth or may change due to repetitive impacting. Recent attention has been paid to the question of measuring the impact energy transferred from the hammer to the pile. In U.S. Pat. No. 5,978,749, Likins Jr. discloses a system for recording data from sensors. The impact energy for the subsequent impact is then manually adjusted, for example, by varying the drop height of the drop-hammer pile driver or by throttling the diesel pile driver to vary the ram stroke. Likewise, in U.S. Pat. No. 6,301,551 (Piscalko et al.), a pile driver analyzer (PDA) collects data from sensors located on the pile itself. However, certain drawbacks are evident from the prior art design. The manual control of the impact energy is both time-consuming and inaccurate. Accordingly, an improved means of controlling the impact energy of the hammer in a pile driver is needed.

SUMMARY OF THE INVENTION

It is thus the object of the present invention to provide an improved control system for a pile driver.

As embodied and broadly described herein, the present invention provides a pile-driving apparatus comprising a hammer for driving a pile (or other foundation element) into the ground; a velocity sensor for measuring the velocity of the hammer; and a control system for controlling the velocity of the hammer based on the velocity measured by said velocity sensor.

After measuring the impact velocity, the control system will compute the impact energy and then compare this with the desired impact energy for the given soil conditions and pile type. The control system will automatically adjust the impact energy for the subsequent hammer stroke based on the readings from the velocity sensor. This automated, velocity-feedback pile driver thus drives piles more efficiently, adjusting itself to the soil conditions and pile type without the need for constant manual readjustment. The impact energy delivered to the pile is thus more optimal than in prior art pile drivers.

Preferably, the pile-driving apparatus further comprises a strain gauge and an accelerometer located on the pile for measuring the strain and acceleration, respectively, of the pile during impact. The strain gauge and accelerometer provide signals to the control system, for determining if a maximum allowable impact energy has been exceeded in which case the control system reduces the velocity of the hammer for the subsequent impact.

The presence of an optional pile driving analyzer uses strain and acceleration data to determine whether the stress imposed on the pile exceeds the maximum allowable stress given the dimensions and Young's modulus of the pile. If the stress is too high, the control system will intervene to reduce the hammer stroke to avoid breaking or damaging the pile. Damage to a pile is, of course, costly and time-consuming, especially when the pile is nearly fully installed. Alternatively, the control system will stop the hammer altogether so that a pile cushion may be installed atop the pile head. Overstressing of piles is thus averted. For example, the U.S. Federal Highway Administration specifies that the stresses in a pile must not exceed a certain limit. The PDA readings thus help to ensure compliance with design requirements and building codes.

BRIEF DESCRIPTION OF THE DRAWINGS

Examples of embodiments of the invention will now be described with reference to the accompanying drawings wherein.

Figure 1:
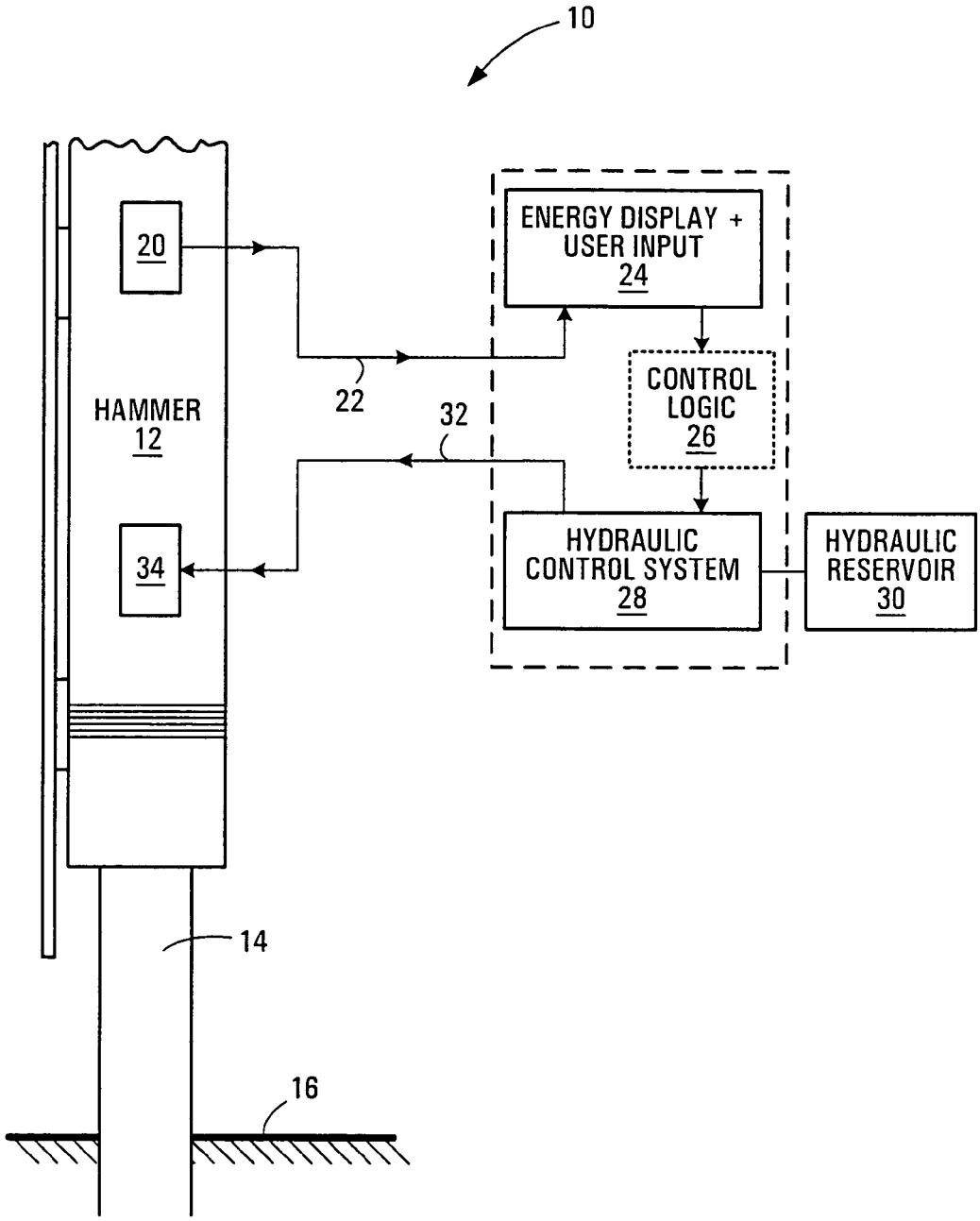
FIG. 1 is a schematic of the pile driver with feedback control system in accordance with one embodiment of the present invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DESCRIPTION OF EMBODIMENTS

Referring to FIG. 1, a pile driver 10 comprises a hammer 12, also known as a ram, which is used to impact the top of a pile 14 so as to drive the pile 14 into the ground 16. In one embodiment, the pile driver 10 is a diesel pile driver. It should be appreciated that embodiments of the present invention can be applied to other types of pile drivers, such as hydraulic pile drivers, pneumatic pile drivers and drop hammers.

Located on the hammer 12 is a velocity sensor 20 that is capable of measuring the velocity of the hammer 12 just before it impacts the pile 14. The velocity sensor 20 is preferably comprised of two magnetic proximity switches (not shown). The pair of magnetic proximity switches is located on the side of the hammer 12. The proximity switches are set to close approximately 1 inch above impact. The time elapsed between the closing of the magnetic proximity switches is transduced into a velocity reading. Alternatively, the velocity sensor 20 could be radar, such as a Doppler radar, which uses the phase shift of the return signal to compute the velocity of the hammer 12.

The velocity sensor 20 sends a signal 22 to an energy display and user input unit 24. The energy display and user input 24 may be a personal computer with a keyboard and monitor. A user would input a target impact energy into the user input 24 based on soil conditions and the type of pile to be driven. The energy display and user unit 24 interfaces with control logic 26. The control logic 26 controls a hydraulic control system 28, which derives its hydraulic power from a hydraulic reservoir 30. The hydraulic control system 28 regulates the hydraulic pressure in a hydraulic control line 32. The hydraulic control line 32 is connected to a fuel system throttle 34, which opens and closes in response to variations in hydraulic pressure in the hydraulic control line 32. The opening and closing of the fuel system throttle 34 regulates the stroke output of the diesel pile driver, thereby causing the hammer 12 to move faster or slower. The control logic 26 thus regulates the fuel system throttle 34 and hence the velocity of the hammer 12 based on the signal 22 from the velocity sensor 20. Therefore, the pile driver 10 can be said to incorporate a velocity-feedback control system to ensure that the correct impact energy is imparted to the pile 14.

In operation, the velocity sensor 20 measures the velocity of the hammer 12 and sends a signal 22 to the control logic 26 via the energy display and user input 24. The control logic 26 computes the actual impact energy based on the velocity reading and compares the actual impact energy with the target impact energy set by the user. If the actual impact energy exceeds the target impact energy, then the control logic intervenes by reducing the velocity of the hammer for the subsequent hammer stroke. To reduce the velocity of the subsequent hammer stroke, the control logic sends a signal to the hydraulic control system 28 which in turn adjusts the pressure in the hydraulic control line 32. The variation in pressure in the hydraulic control line 32 will cause the fuel system throttle 34 to open or close. This will cause the diesel pile driver to increase or decrease its hammer stroke, thereby augmenting or diminishing the impact energy of the subsequent hammer stroke.

Further refinements to the embodiment shown in FIG. 1 will now be discussed with reference to FIG. 2. In addition to measuring the velocity of the hammer 12 (only shown in FIG. 1), the pile driver 10 may also have a pile driving analyzer ("PDA") 40. The pile driving analyzer 40 receives strain data 41 and acceleration data 42 from transducers located on the side of the pile 14. These transducers are a strain gauge 43 and an accelerometer 44, which are located on the side of the pile 14. The strain gauge 43 provides the strain data 41 and the accelerometer 44 provides the acceleration data 42. The PDA when the hammer impacts the pile 14 at its pile head 15. The PDA 40 is known in the art (see, e.g., U.S. Pat. No. 6,301,551). The PDA 40 uses strain and acceleration to determine the stress in the pile 14 during impact, based on knowledge of the elastic modulus of the pile. The PDA 40 thus ensures that the pile 14 is not overstressed. If the stress in the pile 14 is too high, the logic controller 26 reduces the velocity of the subsequent hammer stroke by sending a signal to the hydraulic control system 28 which, in turn, regulates the hammer throttle 34 (also known as the fuel system throttle 34). Alternatively, the PDA 40 may be interfaced with the user input 24 so that the user can set the maximum allowable stress. This allows the user to ensure compliance with installation specifications that prescribe a maximum stress on the pile during installation. Alternatively, the user could input the strength of the material (or select the type of material from a database) and the desired factor of safety. The control logic 26 would then determine the maximum allowable stress by dividing the strength of the material by the factor of safety. In a further refinement, the control logic 26 would monitor not only compressive stress but also tensile and shear stresses.

Figure 2:
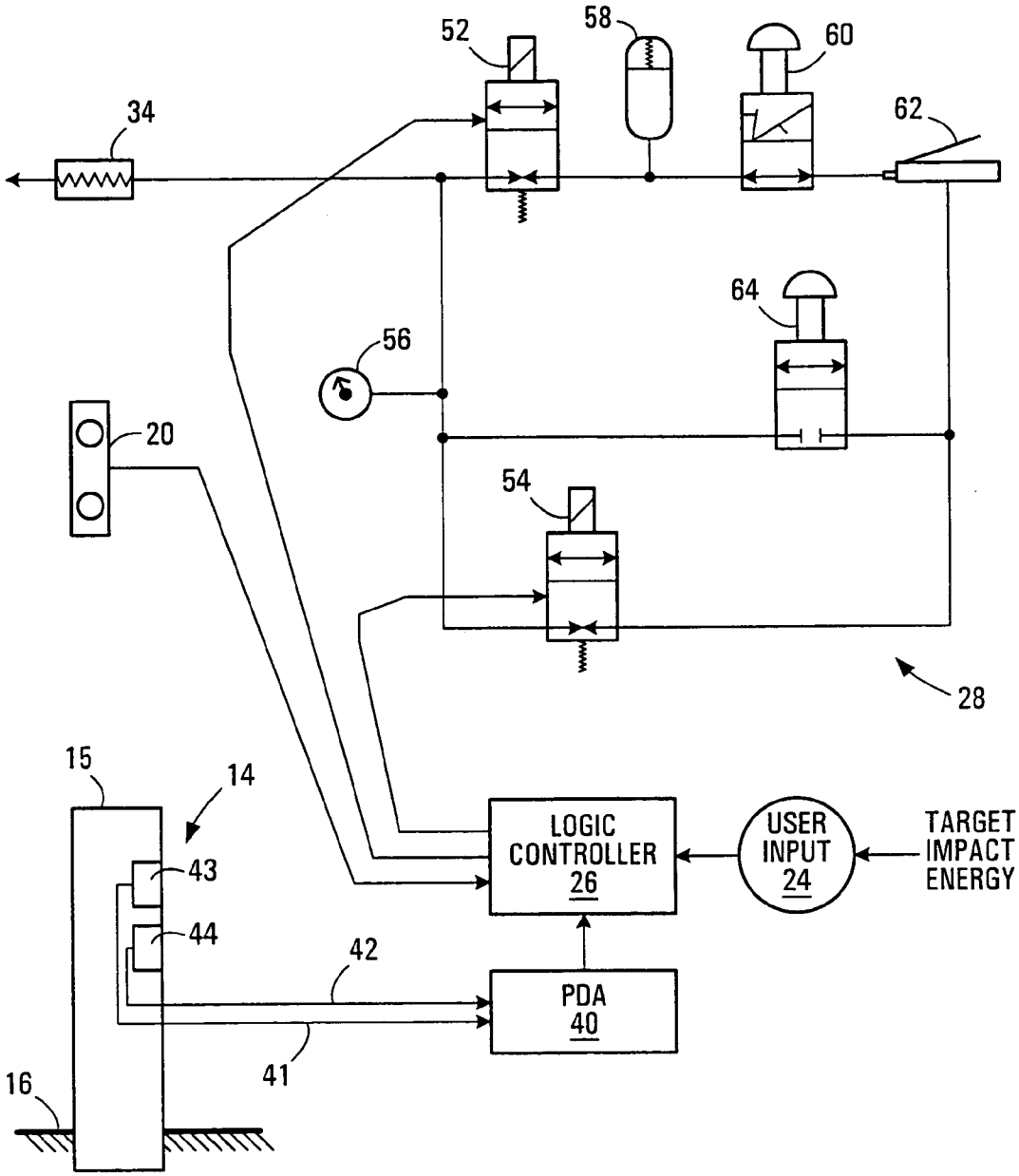
FIG. 2 is a schematic of the pile driver of FIG. 1 illustrating the interfacing of the control logic with the sensors and hydraulic system.

The functioning of the hydraulic control system 28 is also depicted in FIG. 2. The logic controller 26 regulates an Incafase pressure valve 52 and a Decafase pressure valve 54 which together determine the pressure in the hydraulic control line 32. A pressure gauge 56 is provided which may provide feedback to the logic controller. In the refined embodiment of FIG. 2, a hydraulic pressure accumulator 58 is provided in addition to the hydraulic reservoir 30 shown in FIG. 1. Also provided in the hydraulic control system 28 is a manual override 60, also known as an auto-manual switch. The manual override 60 permits the user to manually adjust the hammer throttle 34 by manually pumping a hydraulic hand pump 62. The hydraulic control system 28 also includes an emergency stop button 64 to stop the hammer 34.

The system may be used to drive any elements into the ground, including piles, posts, and any deep foundation elements.

The above description of preferred embodiments should not be interpreted in a limiting manner since other variations, modifications and refinements are possible within the spirit and scope of the present invention. The scope of the invention is defined in the appended claims and their equivalents.

The invention claimed is:

1. A pile-driving apparatus comprising:

a diesel hammer for driving a pile;

a velocity sensor for measuring the impact velocity of said hammer during a hammer stroke; and a control system for controlling the impact velocity of said hammer during a subsequent hammer stroke based on a reading from said velocity sensor during said hammer stroke, said control system comprising a hydraulic control system for controlling a throttle of said hammer to thereby control the impact velocity of said hammer, and a controller operatively coupled to said velocity sensor and to said hydraulic control system for receiving said reading from said velocity sensor and for providing to said hydraulic control system a control signal based on said received reading.

2. A pile-driving apparatus as defined in claim 1 wherein said controlkr computes an actual impact energy imparted to the pile during said hammer stroke and compares the actual impact energy with a target impact energy set by a user.

3. A pile-driving apparatus as defined in claim 2 wherein said target impact energy is detennined based on soil conditions and pile type.

4. A pile-driving apparatus as defined in claim 1 wherein said velocity sensor comprises two magnetic proximity switches located on said hammer.

5. A pile-driving apparatus as defined in claim 1 wherein said velocity sensor is radar-based.

6. A pile-driving apparatus as defined in claim 1 wherein said controller is further operable to receive inputs from a system that analyzes the strain and acceleration of said pile during impact of said hammer during said hammer stroke, and to provide to said hydraulic control system a control signal to cause said hydraulic control system to adjust the throttle so as to adjust the impact velocity of the hammer for the subsequent hammer stroke based on the received inputs.

7. A pile-driving apparatus as defined in claim 1 wherein said hydraulic control system comprises a manual override for enabling a user to disable the controller so as to continue pile driving by manually adjusting the throttle.

8. A pile-driving apparatus as defined in claim 1 wherein said throttle comprises a diesel throttle located on said hammer and wherein said hydraulic control system regulates said diesel throttle.

9. A pile-driving apparatus as defined in claim 1 wherein said hydraulic control system controls the impact velocity of said hammer by controlling pressure in a hydraulic control line.

10. A pile-driving apparatus as defined in claim 9 wherein said hydraulic control system comprises:

respective hydraulic valves operatively coupled to said controller for increasing and decreasing the pressure in said hydraulic control line responsive to control signals provided by the controller.

11. A pile-driving apparatus as defined in claim 9 wherein said hydraulic control system comprises:

a pressure gauge, operatively coupled to said hydraulic control line and to said controller, for measuring the pressure in said hydraulic control line and for providing feedback to said controller.

12. A pile-driving apparatus as defined in claim 9 wherein said hydraulic control system comprises:

an emergency stop operatively coupled to said hydraulic control line for enabling a user to stop said hammer.

13. A pile-driving apparatus as defined in claim 9 wherein said hydraulic control system comprises:

a manual override operatively coupled to said hydraulic control line for enabling a user to disable said controller; and a manual hydraulic pump operatively coupled to the manual override for enabling a user to manually control the throttle and the impact velocity of said hammer by manually adjusting the pressure in said hydraulic control line.

14. A pile-driving apparatus as defined in claim 1, further comprising:

an energy display and user input unit operatively coupled to the controller for providing a display of impact energy to a user and for receiving user input from a user.

15. A pile-driving apparatus as defined in claim 14 wherein said user input comprises a target impact energy.

* * * * *